US005810086A

United States Patent [19]

Bridges

[11] Patent Number: 5,810,086

[45] Date of Patent: Sep. 22, 1998

[54] SINGLE RISER WITH TWO WELLHEADS

[75] Inventor: Charles D. Bridges, Cypress, Tex.

[73] Assignee: ABB Vetco Gray Inc., Houston, Tex.

[21] Appl. No.: 759,542

[22] Filed: Dec. 5, 1996

[51] Int. Cl.[6] ..... E21B 43/01

[52] U.S. Cl. ..... 166/349; 166/366; 166/313; 175/5

[58] Field of Search ..... 166/342, 349, 166/366, 313, 52; 175/5, 7, 9

[56] References Cited

U.S. PATENT DOCUMENTS

| | | | |
|---|---|---|---|
| 4,068,729 | 1/1978 | Peevey . | |
| 4,136,996 | 1/1979 | Burns . | |
| 5,330,007 | 7/1994 | Collins et al. . | |
| 5,458,199 | 10/1995 | Collins et al. . | |
| 5,560,435 | 10/1996 | Sharp | 166/313 X |

OTHER PUBLICATIONS

T.G. Tompkins; Mobil Prepares for Record–Making Project; Offshore, May, 1979.

2 pages of drawings; undated; prepared by Gray Tool Company approximately 1997.

*Primary Examiner*—William P. Neuder

*Attorney, Agent, or Firm*—James E. Bradley

[57] ABSTRACT

A guidance system comprising two guide tubes are lowered into a well with a conductor. The guide tubes are connected together by partitions which divide the conductor into two halves. Each partition comprises two symmetrical half sections facing in opposite directions. The operator lowers a string of drill pipe into the conductor to drill a first smaller diameter well at the bottom of the conductor. After drilling to the desired depth, the operator runs a first string of casing down the conductor and through the new well bore. The casing is located on one side of each partition and cemented in place. The operator then lowers the drill pipe down the other side of the partitions and repeats the drilling and casing of a second well.

28 Claims, 3 Drawing Sheets

SINGLE RISER WITH TWO WELLHEADS

TECHNICAL FIELD

This invention relates generally to drilling wells, and more particularly to an apparatus for drilling two wells in a single conductor.

BACKGROUND ART

A typical offshore well installation comprises a single conductor in a single well. If necessary, several wells may be located side by side in a template. Multiple wells may also be drilled within a single conductor pipe. One example of such an installation utilized a conductor with a diameter the size of a leg of a drilling platform and contained up to 12 wells. That installation utilized a guide member lowered on a riser into the conductor. The guide member had slots for each well along its periphery. U.S. Pat. No. 5,458,199 shows two wells in a conductor with a guide member at the lower end of the conductor, but an improved guide means is desirable.

SUMMARY OF THE INVENTION

A guidance system comprising two guide tubes is lowered into a well with a conductor. The guide tubes are connected together by partitions which are about 100 feet apart and divide the conductor into two halves. Each partition comprises two symmetrically formed, semi-cylindrical sections facing in opposite directions. The guide tubes are supported by a plate at the upper end of the conductor. The operator lowers a string of drill pipe into the conductor to drill a first smaller diameter well at the bottom of the conductor. After drilling to the desired depth, the operator runs a first string of casing down the conductor and through the new well bore. The casing is located on one side of each partition and cemented in place. The operator then lowers the drill pipe down the other side of the partitions and repeats the drilling and casing of a second well. After each well is cased, the operator pumps cement down one of the guide tubes to cement the interior of the lower end of the conductor.

DETAILED DESCRIPTION OF THE INVENTION

Figure 1:
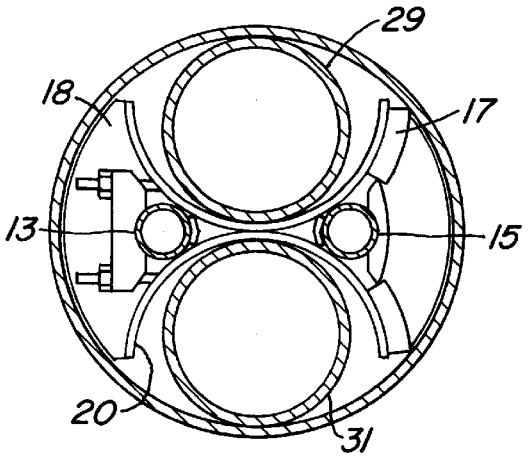
FIG. 1 is sectional top view of a partition of the guidance system in a conductor taken along the line 1—1 in FIG. 2.
Figure 2:
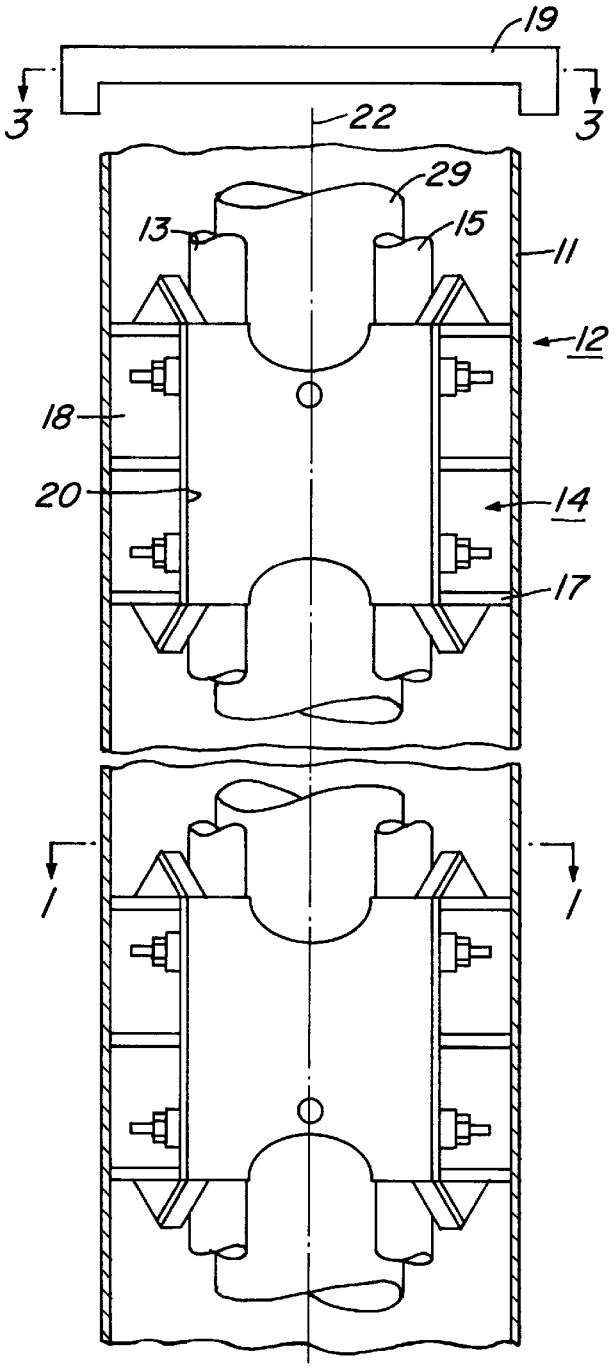
FIG. 2 is a fragmented side view of the guidance system shown installed in a conductor pipe with one string of casing and is constructed in accordance with the invention.

Referring to FIG. 2, a large diameter string of conductor 11 with a longitudinal axis 22 is installed in a well 12 to a first depth. Conductor 11 is a steel pipe, typically 36 inches in diameter. Conductor 11 normally extends from a drilling platform at sea level downward to the sea floor and may extend several hundred feet into the earth. A guidance system 14 comprising two guide tubes 13 and 15 is lowered into conductor 11. In the preferred embodiment, guide tubes 13 and 15 consist of five inch diameter tubing. Guide tubes 13 and 15 are connected together by a plurality of partitions 17 which are preferably bolted to guide tubes 13 and 15. Partitions 17 are about 100 feet apart, and as shown in FIG. 1, have outer edges or webs 18 that extend out to the bore of conductor 11, thereby dividing conductor 11 into two halves. Webs 18 have an outer dimension that is transverse to longitudinal axis 22 that is approximately equal to the inner diameter of conductor 11. Each partition 17 comprises two symmetrically formed, semi-cylindrical sections 20 facing in opposite directions. The axes of section 20 and guide tubes 13 and 15 are located 90 degrees apart from each other relative to longitudinal axis 22 of conductor 11.

Figure 3:
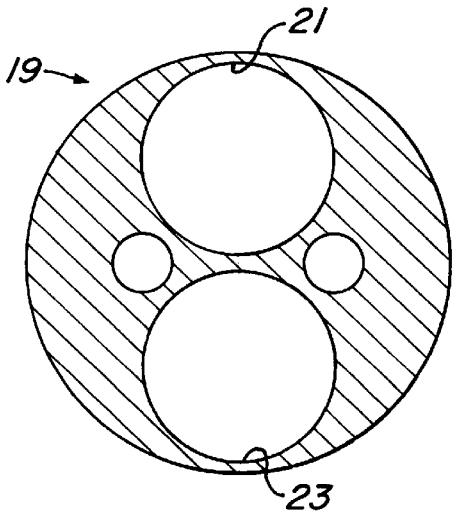
FIG. 3 is a sectional top view of the mounting plate taken along the line 3—3 in FIG. 2.
Figure 4:
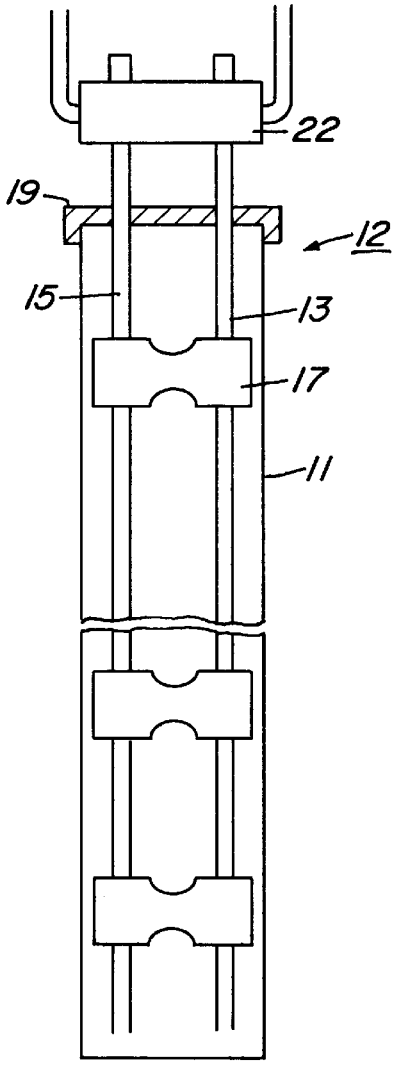
FIG. 4 is a schematic drawing of the guidance system shown in a conductor pipe during the initial installation phase.

Referring to FIG. 4, guide tubes 13 and 15 are secured to a conventional drilling rig elevator 22 and lowered into conductor 11. Approximately every 100 feet, elevator 22 stops lowering guide tubes 13 and 15 so that a partition 17 may be fastened to them. Elevator 22 resumes lowering the assembly into conductor 11 and repeats the sequence until the first depth of well 12 is reached by guide tubes 13 and 15. Referring to FIGS. 2 and 3, the upper ends of guide tubes 13 and 15 are then landed in a plate 19 which is mounted to the upper end of conductor 11 and elevator 22 is removed. Plate 19 also has two holes 21 and 23 of larger diameter for two strings of casing.

Figure 5:
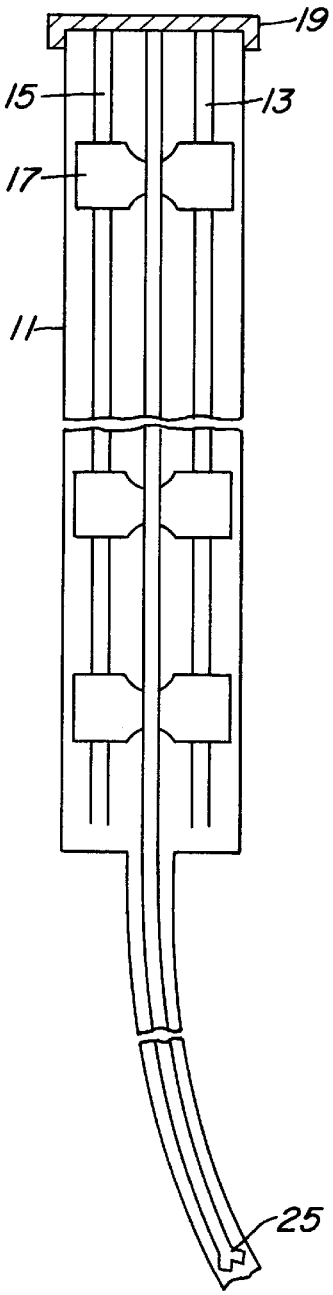
FIG. 5 is a schematic drawing of the guidance system of FIG. 4 showing a first well being drilled.
Figure 6:
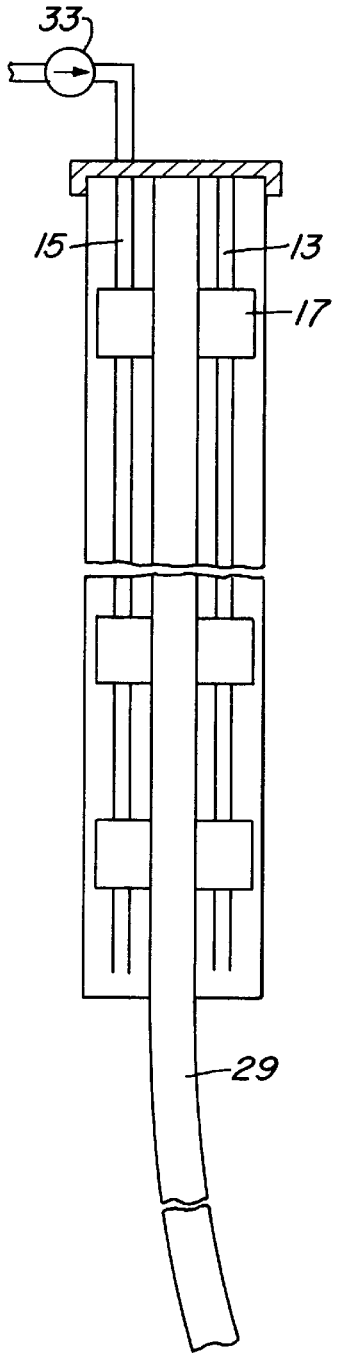
FIG. 6 is a schematic drawing of the guidance system of FIG. 4 showing a first completed well.
Figure 7:
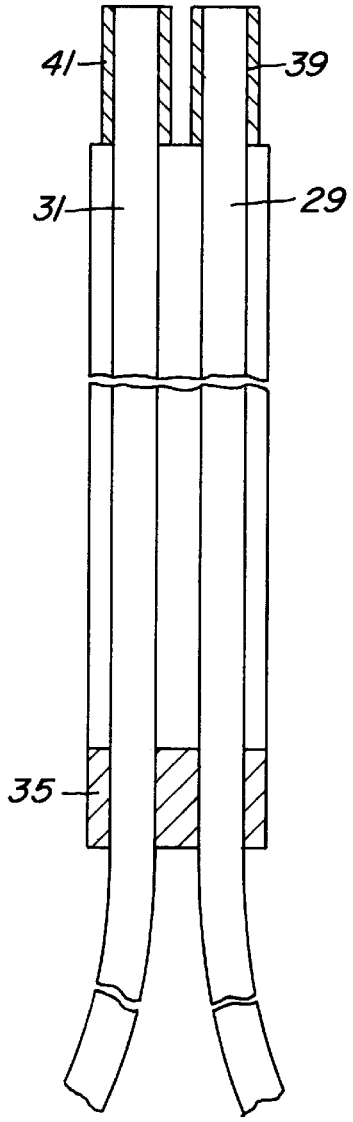
FIG. 7 is a schematic drawing of two completed wells in a single conductor after the guidance system has been removed.

A conventional drilling diverter (not shown) is installed on plate 19. Referring to FIG. 5, a string of drill pipe 25 is run through the diverter and hole 21. Drill pipe 25 is used to drill a first smaller diameter well from the lower end of the bore of well 12 containing conductor 11 to a desired depth. Circulation will be up conductor 11 and the diverter. Hole 23 will be plugged off. Referring to FIG. 6, a first string of casing 29 is run through hole 21, down conductor 11, and through the new well bore before it is cemented in place. Casing 29 is located on one side of guide tubes 13 and 15 and partitions 17. The upper end of casing 29 lands in plate 19. Repeating the sequence, drill pipe 25 is then lowered through the diverter, hole 23 and down the other side of guide tubes 13, 15 and partitions 17 to drill a second well bore. As shown in FIG. 7, drill pipe 25 is removed and a second string of casing 31 is cemented in its place. Casing 31 lands in hole 23 of plate 19. After both strings of casing 29, 31 are in place, the interior of the lower end of conductor 11 is plugged off by pumping cement from pump 33 (FIG. 6) down one of guide tubes 13, 15. When the wells are complete, casing strings 29 and 31 extend upward to the surface and wellhead housings 39 and 41 are mounted to each casing 29, 31, respectively. A cement plug 35 will be located at the bottom of conductor 11. The guidance assembly comprising guide tubes 13, 15 and partitions 17 remain in conductor 11.

The invention has several advantages. The invention provides a guidance system for sequentially guiding a drill string to drill two wells in a single conductor bore. The invention also provides means for separating the casings for the two wells during completion of the wells.

While the invention has been shown in only one of its forms, it should be apparent to those skilled in the art that it is not so limited, but is susceptible to various changes without departing from the scope of the invention.

I claim:

1. An apparatus for creating two wells in a single conductor which has a bore, the apparatus comprising in combination:

a guide assembly having a pair of guide tubes, each guide tube having a longitudinal axis, the guide tubes being parallel to and spaced apart from each other;

the guide assembly having a plurality of partitions securing the guide tubes to each other, the partitions being spaced apart from each other along the longitudinal axes of the guide tubes; and wherein the guide assembly is adapted to be lowered into the conductor to divide the conductor into two halves such that a drill string and casing may be run sequentially down each half of the conductor, for drilling and casing two separate wells below the conductor.

2. The apparatus according to claim 1, further comprising:

an upper end on each guide tube; and a plate located at an upper end of the conductor for landing the upper ends of the guide tubes, the plate having holes for receiving the drill string and the casings.

3. The apparatus according to claim 1 wherein the partitions have a transverse dimension perpendicular to the longitudinal axes approximately equal to a diameter of the bore.

4. The apparatus according to claim 1 wherein each of the partitions has at least two outer edges on opposite sides of the guide tubes, the edges being adapted to contact the bore of the conductor.

5. The apparatus according to claim 1 wherein each of the partitions comprises two symmetrically formed, generally concave sections facing in opposite directions, each of the sections adapted to guide the drill string and one of the casings.

6. The apparatus according to claim 1 wherein each of the partitions comprises two symmetrically formed, semi-cylindrical sections facing in opposite directions, each of the sections adapted to guide the drill string and one of the casings.

7. The apparatus according to claim 1 wherein each of the partitions comprises:

two symmetrically formed, semi-cylindrical sections facing in opposite directions, each of the sections having an axis and adapted to guide the drill string and one of the casings; and wherein the axes of the sections and the axes of the guide tubes are 90 degrees apart from each other relative to a longitudinal axis of the conductor.

8. An apparatus for creating two wells in a single conductor which has a bore, the apparatus comprising in combination:

a guide assembly having a pair of guide tubes, each guide tube having a longitudinal axis, the guide tubes being parallel to and spaced apart from each other;

the guide assembly having a plurality of partitions, each partition having two symmetrically formed, generally concave sections facing in opposite directions; and wherein the guide assembly is adapted to be lowered into the conductor to divide the conductor into two halves such that a drill string and casing may be run sequentially down each half of the conductor through each concave section to form two separate cased wells below the conductor.

9. The apparatus according to claim 8, wherein each of the concave sections is semi-cylindrical.

10. The apparatus according to claim 8 wherein each of the concave sections has an axis; and wherein the axes of the sections and the axes of the guide tubes are 90 degrees apart from each other relative to a longitudinal axis of the conductor.

11. The apparatus according to claim 8, further comprising means for pumping cement down one of the guide tubes into a lower portion of the conductor to seal around the casings for the first and second wells.

12. A method of creating two wells from a primary bore, the method comprising:

a.) installing a conductor in the primary bore;

b.) providing a pair of guide tubes, each guide tube having a longitudinal axis and an upper end;

c.) securing the guide tubes to each other with a plurality of partitions spaced along the longitudinal axes of the guide tubes, the guide tubes being parallel to and spaced apart from each other;

d.) lowering the guide tubes into the conductor with the partitions installed on the guide tubes, the partitions and the guide tubes dividing the conductor into two halves;

e.) running a drill string down one of the halves of the conductor and drilling a first well below the conductor to a desired depth;

f.) removing the drill string, and lowering casing through the same half of the conductor in the first well and cementing the casing in place; and g.) repeating steps (e) and (f) with the drill string in the other half of the conductor to form a second well.

13. The method according to claim 12, wherein after step (g.) the method further comprises pumping cement down one of the guide tubes into a lower portion of the conductor to seal around the casings for the first and second wells.

14. The method according to claim 12, further comprising landing the upper ends of the guide tubes on a plate located at an upper end of the conductor.

15. An apparatus for creating a plurality of wells in a single conductor which has a bore, the apparatus comprising in combination:

a guide assembly having a plurality of parallel supports, each support having a longitudinal axis;

the guide assembly having a plurality of partitions secured to the supports, the partitions being spaced apart from each other along the longitudinal axes of the guide tubes; and wherein the guide assembly is adapted to be lowered into the conductor to divide the conductor into a plurality of sections such that a drill string and casing may be run sequentially down each section of the conductor, for drilling and casing two separate wells below the conductor.

16. The apparatus according to claim 15, further comprising:

an upper end on each support; and a plate located at an upper end of the conductor for landing the upper ends of the supports, the plate having holes for receiving the drill string and the casings.

17. The apparatus according to claim 15 wherein the partitions have a transverse dimension which is perpendicular to the longitudinal axes and approximately equal to a diameter of the bore.

18. The apparatus according to claim 15 wherein each of the partitions has at least two outer edges on opposite sides of the supports, the edges being adapted to contact the bore of the conductor.

19. The apparatus according to claim 15 wherein each of the partitions comprises two symmetrically formed, generally concave sections facing in opposite directions, each of the sections being adapted to guide the drill string and one of the casings.

20. The apparatus according to claim 15 wherein each of the partitions comprises two symmetrically formed, semi-cylindrical sections facing in opposite directions, each of the sections being adapted to guide the drill string and one of the casings.

21. The apparatus according to claim 15 wherein each of the partitions comprises:

two symmetrically formed, semi-cylindrical sections facing in opposite directions, each of the sections having an axis and adapted to guide the drill string and one of the casings; and wherein the axes of the sections and the axes of the supports are 90 degrees apart from each other relative to a longitudinal axis of the conductor.

22. An apparatus for creating two wells in a single conductor which has a bore, the apparatus comprising in combination:

a guide assembly having a pair of supports, each support having a longitudinal axis, and the supports being parallel to and spaced apart from each other;

the guide assembly having a plurality of partitions, each partition having two formed profiles facing radially outward; and wherein the guide assembly is adapted to be lowered into the conductor to divide the conductor into two halves such that a drill string and casing may be run sequentially down each half of the conductor through each profile to form two separate cased wells below the conductor; and wherein one of the supports is a tube which is capable of circulating fluid between the surface and the conductor.

23. The apparatus according to claim 22, wherein each of the profiles is semi-cylindrical.

24. The apparatus according to claim 22 wherein each of the profiles has an axis; and wherein the axes of the profiles and the axes of the supports are 90 degrees apart from each other relative to a longitudinal axis of the conductor.

25. The apparatus according to claim 22, further comprising means for pumping cement down the tube into a lower portion of the conductor to seal around the casings for the first and second wells.

26. A method of creating two wells from a primary bore, the method comprising:

a) installing a conductor in the primary bore;

b) providing a plurality of supports, each support having a longitudinal axis and an upper end;

c) securing the supports to each other with a plurality of partitions spaced along the longitudinal axes of the supports, the supports being parallel to and spaced apart from each other;

d) lowering the supports into the conductor with the partitions installed on the supports, the partitions and the supports dividing the conductor into two sections; and e) running a drill string down one of the sections of the conductor and drilling a first well below the conductor to a desired depth.

27. The method according to claim 26, wherein after step (e) the method further comprises pumping cement down one of the supports into a lower portion of the conductor to seal around the casing for the first well.

28. The method according to claim 26, further comprising landing the upper ends of the supports on a plate located at an upper end of the conductor.

* * * * *

UNITED STATES PATENT AND TRADEMARK OFFICE

CERTIFICATE OF CORRECTION

PATENT NO. : 5,810,086

DATED : 09/22/98

INVENTOR(S) : CHARLES D. BRIDGES

It is certified that error appears in the above-identified patent and that said Letters Patent is hereby corrected as shown below:

On the title page,

References Cited, Other Publications, second entry should be --2 pages of drawings; undated; prepared by Gray Tool Company approximately 1977--.

Signed and Sealed this

Fourth Day of May, 1999

*Attest:*

*Attesting Officer*

Q. TODD DICKINSON

*Acting Commissioner of Patents and Trademarks*